United States Patent [19]

Petersen

[11] Patent Number: 5,067,298

[45] Date of Patent: Nov. 26, 1991

[54] METHOD FOR PLAZA DECK CONSTRUCTION

[75] Inventor: Wayne E. Petersen, Eden Prairie, Minn.

[73] Assignee: The Dow Chemical Company, Midland, Mich.

[21] Appl. No.: 545,154

[22] Filed: Jun. 28, 1990

[51] Int. Cl.[5] ..... E04G 21/00; E04C 1/00; E04C 2/32

[52] U.S. Cl. ..... 52/741; 52/169.5; 52/199; 52/309.4; 52/309.5; 52/309.8; 52/309.12; 52/746; 156/324.4

[58] Field of Search ..... 52/309.5, 309.8, 309.12, 52/302, 408, 410, 199, 169.5, 746, 303, 309.4; 156/324.4

[56] References Cited

U.S. PATENT DOCUMENTS

| | | | |
|---|---|---|---|
| 3,455,076 | 7/1969 | Clarvoe | 52/302 |
| 3,619,961 | 11/1971 | Sterrett et al. | 52/309.12 |
| 4,658,554 | 4/1987 | Riley et al. | 52/309.8 |
| 4,677,800 | 7/1987 | Roodvoets | 52/309.12 |
| 4,712,349 | 12/1987 | Riley et al. | 52/408 |

OTHER PUBLICATIONS

Styrofoam Thermadry Brand Insulating Drainage Panels for Superior Insulation and Water Drainage, Dow Chemical Company literature Form. No. 179-3084-788 RJD.

*Primary Examiner*—David A. Scherbel
*Assistant Examiner*—Deborah McGann Ripley

[57] ABSTRACT

A method to construct a plaza deck/parking structure in which a waterproof membrane is applied to the base deck. Panels of foam insulation material are provided on top of the membrane and on the upper side of these panels there is a channeled/ribbed structure. Affixed to the top of the ribs in each panel is a porous fabric which permits moisture and water vapor to penetrate the fabric and collect in the channels. The existence of the fabric layer permits the addition of concrete to the structure by simply pouring wet concrete directly onto the fabric-covered foam panels, instead of having to transport solid, heavy concrete slabs to the top of parking structures. The channeled/ribbed structure of the foam plastic insulation provides for ventilation and moisture removal which leads to better wearability of the insulation material in the plaza deck parking structure.

26 Claims, 1 Drawing Sheet

METHOD FOR PLAZA DECK CONSTRUCTION

BACKGROUND OF THE INVENTION

This invention relates to a method for constructing plaza decks or the like. A plaza deck is typically made up of a structural deck, a waterproof (non-permeable) membrane, an intervening foam insulation board, and a top concrete wearing slab. A known problem with this type of structure is a moisture build-up between the wear slab and the membrane This degrades the insulation value of the foam insulation board and can, and often does, cause freeze/thaw spalling of the cementicious wearing slab In order to alleviate the problems caused by moisture build-up between the wearing slab and the membrane, it is understood by the industry (and further supported by ASTM standard) that drainage is required (or at least recommended) between the insulation and the top covering. Some applications also include drainage between the membrane and the insulation. Drainage reduces the possibilities of moisture accumulation in the insulation (and therefore a reduction in thermal resistance) and moisture accumulation in the bottom side of the wear slab and, therefore, reducing the potential for freeze/thaw spalling.

With standard insulation products currently being used in plaza deck construction, the drainage layer usually consists of loose gravel or epoxy bound gravel. This drainage layer is often covered with a layer of construction fabric which is then covered with poured concrete or a preformed concrete panel. The labor and material costs associated with installation of such a gravel layer above or above and below the membrane are significant because loose gravel and/or epoxy bound gravel require considerable handling expertise in order for them to be transported to the job site, and these materials require intensive labor to be applied. Further, the gravel layer adds weight necessitating structural considerations and height which is often limited in reroof situations causing detailing difficulties.

Ways to avoid the installation of loose gravel or epoxy bound gravel as the drainage layers in these protected membrane roofing structures were recited in U.S. Pat. Nos. 4,658,554 and 4,712,349. In both of these patents, the insulation layer itself provides the necessary drainage in that the insulation is a type of foamed plastic that is sculpted such that its top surface is made up of elongated ribs arrayed, with cut-out channels interposed between them, with the walls surrounding the channels demarking the ribs. This channel/rib construction provides for drainage of moisture that accumulates between the insulation panels and wearing slabs. In both of these patents all of the insulation panels have a plastic film laminated to the lower surface of the insulation panel such that the plastic film prevents migration of moisture vapor through the insulation to the insulation wearing slab interface from the waterproof membrane. This type of dual moisture retarder and drain-away system provides for adequate drainage in these types of roofing structures.

The disadvantage of the methods outlined in the '554 and the '349 patent is that in both methods, in order to finish the roofing structure, concrete panels have to be laid directly on top of the polystyrene foam. Because the concrete panels have to be laid directly on top of the foam, this means that these concrete panels have to be created in one location, then transported to the job site, and at the job site the panels have to be lifted to the working area, wherever it may be—the roof—or various levels of a parking structure. As is well known, the transportation of extremely heavy, unbalanced concrete slabs is difficult, time consuming and extremely expensive, both from a materials standpoint and a labor standpoint. Further, a top covering comprised of preformed wearing slabs is typically not appropriate for loads heavier than pedestrian traffic. For loads like vehicle traffic monolithic wearing slabs are needed to adequately distribute loads and prevent damage to the underlying insulation layer.

SUMMARY OF THE INVENTION

In the present invention, the need for gravel or epoxy bound gravel layers and/or the need to use only preformed concrete slabs is eliminated by replacing standard solid foam insulation or foam with top channels with a foam insulation layer having drainage channels formed in its upper surface and also having a layer of porous construction fabric stretched over said channels and affixed to the foam. This foam composite is laid on the water impermeable layer, fabric covered channels facing up, and wet concrete or an equivalent construction composite material is poured over said fabric. After shaping to the desired size and thickness, the concrete is allowed to cure in a conventional manner. The resulting structure has excellent properties for its intended use. This method also has a great cost savings advantage over current typical methods of plaza deck construction in that it is less labor intensive because it eliminates certain layers of materials that have to be applied. Also, it is less expensive because the application of concrete is no longer a multi-step process of forming the concrete, transporting it to the job site, and applying it at the required level. With this method the concrete is simply poured wet onto the top of the foam layer and allowed to cure there, which time, energy and money.

DESCRIPTION OF THE PREFERRED EMBODIMENTS

Figure 1:
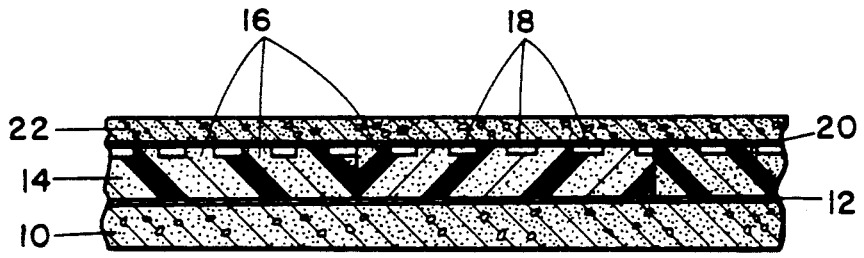
FIG. 1 is a fragmentary cross-sectional view of a plaza or parking deck structure constructed in accordance with the principles of the present invention.

In the preferred embodiment, a waterproof membrane 12 overlies a base deck 10 made of reinforced concrete or the like. Membrane 12 can be attached to base deck 10, or can be placed loose on the deck. Membrane 12 can be a single sheet of polymeric material, liquid applied, modified bituminous sheet, or it can be an asphalt built up membrane. Insulation foam panels 14, preferably made of polystyrene foam, are laid on top of membrane 12. Foam panels 14 include, on the top surface only, (FIGS. 1 and 2) integral ribs 16 interspaced by channels or valleys 18.

The ratio of channel area to the total surface area of the foam panel is 20% to 80%. A ratio of 40% channel area to the total surface area of the foam panel was selected as the ratio for use in testing of the system.

The channels either can be created when the foam panel is extruded or they can be created by cutting the panels after they have been formed. Methods found to be workable in forming the grooves include cutting them with a router or a hot wire or a hot knife.

There are no measurable differences in compressive strength and moisture permeability of foam panels that have had channels formed when the panels were extruded versus foam panels that had had channels cut into them by one of the above-listed methods.

The panels themselves have length and width dimensions in which the length varies from ¼ foot to 4 feet and the width varies from 4 feet to 20 feet. The dimensions of the panels primarily used in the development of this invention were 2 feet by 4 feet and 2 feet by 8 feet. Product size is not a critical factor, but handleability is. Within these plaza deck construction areas, foam panels 14 must not be so large as to be blown from a roof before concrete can be applied to hold them down.

The width of the channels in the top surface of each panel varies from 1/16 inch to 1 inch. A midrange of values for the width of the channels is ⅛ inch to ½ inch and the width of the channels on the panels primarily used in developing this invention was 3/16 inch to ⅜ inch.

The depth of the channels in the top surface of each panel varies from 1/10 inch to 1 inch. A midrange of values for the depth of the channels is ⅛ inch to ½ inch and the depth of the channels on the panels primarily used in creating this invention was ¼ inch to ⅜ inch.

The ribs around the channels in the preferred embodiment varied in width from ⅛ inch to 5 inches. An intermediate range of values for the width of the ribs is from ¼ inch to 1 inch. The width of the ribs in the panels primarily used in creating this invention was ½ inch.

The compressive strength of the foam panels varies from 1440 pounds per square foot (psf) to 28,800 psf. Target values for compressive strength of the foam panels used in developing this invention were 3,600 psf, 7,200 psf and 10,080 psf. The compressive strength of the foam panels would have to be greater when the depth of the channel was reduced, in order for the channel to remain intact because of the weight of the concrete.

Figure 2:
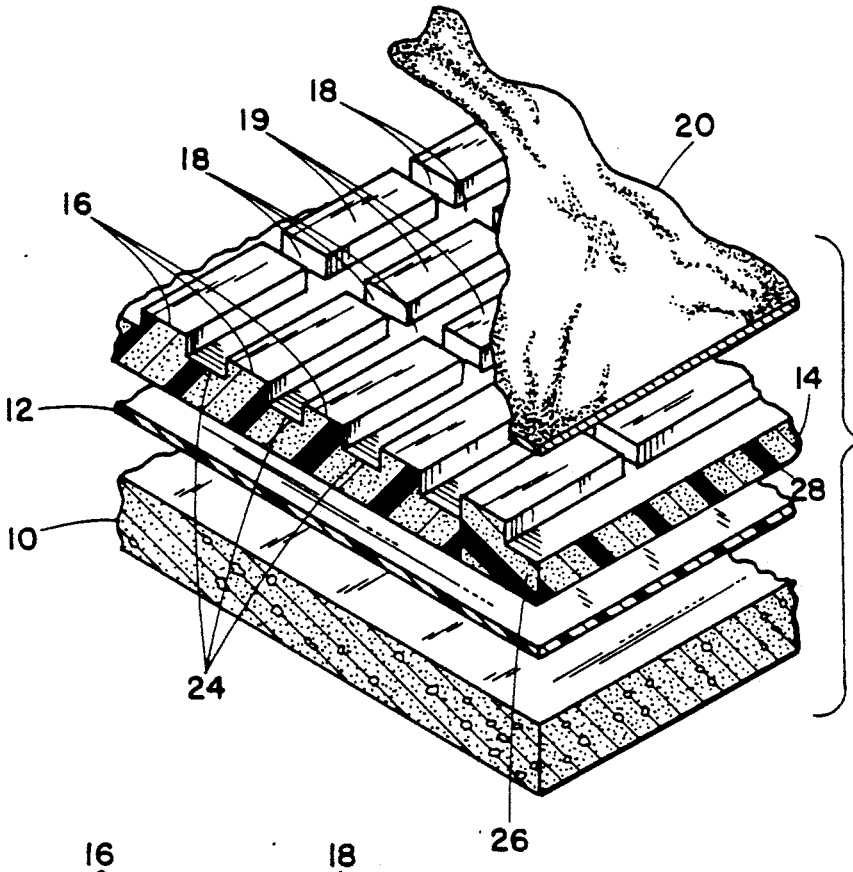
FIG. 2 is an exploded fragmentary perspective view showing one embodiment of the cross-cutting channels and rib structure in the foam panels and a cut-away view of the porous fabric layer the panel without showing the top concrete layer.

The channel-rib structure on the foam panels can be in any pattern desired from straight lines to an interconnecting pattern of rectangular ribs and channels, to some sort of diamond pattern or even a "wiggle-waggle" pattern of interconnecting curved channels with odd-shaped ribs. FIG. 2 shows a rectangular pattern of inter-connected channels and ribs on the top surface of the foam panel.

Figure 3:
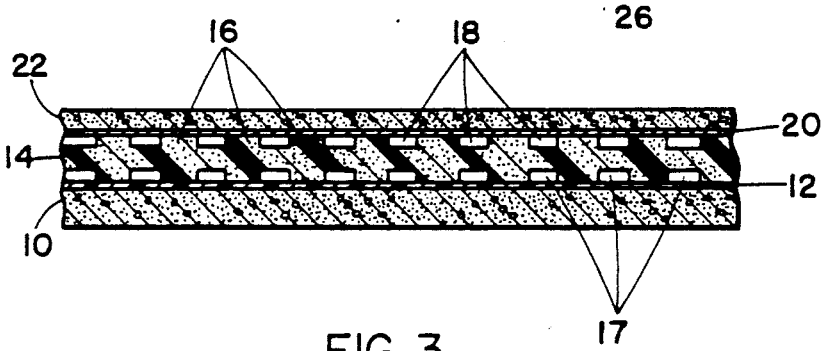
FIG. 3 is a fragmentary cross-sectional view of another embodiment of the plaza or parking deck structure, constructed in accordance with the principles of the present invention, in which the foam layer includes channels on both the top and bottom.

An additional pattern of channels and ribs can be constructed on the bottom of each foam panel (FIG. 3). Should there be this additional pattern of channels and ribs on the bottom of each foam panel then the ratio of channel area on the bottom to the total channel area (on the top and bottom) is from 5 to 50%.

The foam material at the rib section 16 is stronger, more rigid, and more deformation resistant than is are abutted together along the longitudinal side edges 26 thereof. The ends 28 of panels 14 also are abutted together. While these panels are preferably made of polystyrene foam, other foam insulating materials could also be used. The foam panels made of polystyrene are made of the closed cell variety of polystyrene to prevent moisture penetration.

Porous fabric 20 is adhered by an adhesive, such as a hot melt adhesive or a 1-part or 2-part urethane adhesive, to the top surface 19 of ribs 16, as shown in FIG. 2. (The concrete wear slab 22 is not shown in FIG. 2 so that fabric 20 is clearly visible.) Fabric 20 is sufficiently porous to permit free passage of water into the channels, but not so porous as to permit wet concrete to significantly penetrate channels 18 on the top surface of panel 14. Porous fabric 20 can be either a non-woven or woven fabric. Two materials that fabric 20 could be made of include polypropylene and fiberglass. Typical standards for the fabric are: a weight per panel in ounces per square yard of 4.10 and grab strength, in pounds, of 115; a rating of 140 gpm/ft$^2$ for flow; and an equivalent opening size on U.S. units of 70 to 100. (These numbers are typical property values, not to be construed as rigid specifications.)

In use, impermeable membrane 12 is first placed on base deck 10. Foam panels 14 are then arranged in a closely adjacent edgewise fashion on impermeable membrane 12, with the fabric covered channels facing up. Once foam panels 14 are all in place, concrete is poured on top of fabric 20 and allowed to cure into concrete slab 22. During the pouring of the concrete, fabric 20 prevents the wet concrete from significantly entering channels 18 in panel 14.

There is a slight adjustment in the level of concrete required, for poured-in-place concrete top coverings because the profiled surfaces reduces the bearing area compared to flat board stock and therefore reduces the modulus of foundation at the foam. Therefore, when a rib profiled product is considered, in order to maintain the same maximum loading capabilities (flat board stock and gravel versus profiled foam), a slightly thicker concrete layer would be required (about 5%) if the apparent foundation modulus of the insulation product is reduced in half.

FIG. 3 illustrates a embodiment of the invention in which channels are cut, not only in the top, but also on the bottom of panel 14. Channel 17 on the bottom of panel 14 can be aligned with channels 18 on the top of panel 14 in order to maximize the load bearing strength of ribs 16. The embodiment shown in FIG. 3, with a top and bottom pattern of channels would have enhanced drainage capabilities.

This invention works to drain moisture away from the critical layers in plaza deck construction because the structure of the channels in the surface of the foam insulation panels permits air circulation so that any rain water or other moisture that penetrates to the insulation layer is trapped and ends up dissipating on hot, dry days. Moisture penetration of the foam panel, and resulting loss of insulating qualities, therefore, is substantially reduced by the present invention. As stated in the previous section, certain interconnecting patterns of channels allow for multi-directional drainage due to the cross-cutting linkage of the ribs and channels.

An existing commercial product that will work in the method of this invention to provide the fabric covered insulation foam panels is STYROFOAM® THERMADRY™ Brand Insulating Drainage Panels. This product is offered for sale by the Dow Chemical Company. Styrofoam® Brand Products, 2020 Willard H. Dow Center, Midland, Mich. 48674. The Styrofoam® Thermadry™ Brand Insulating Drainage Panels are available in thicknesses ranging from 1.5 to 2.55 inches.

Their compressive strength in psf ranges from 1250 to 1750; their minimum flow rate in gpm/ft (width) is 5; and their R-value in h.ft$^{2}$·° F/btu ranges from 6.9 to 10.6. Styrofoam® Thermadry™ brand Insulating Brand Drainage Panels have heretofore only been recommended for use in below-ground construction in which the panels are placed vertically against an in-place foundation to aid in drainage of moisture away from the foundation. Styrofoam® Thermadry™ Brand Insulating Drainage Panels have not, prior to the present invention, been recommended by the manufacturer for horizontal plaza deck applications, where concrete would be poured over the upper channeled surface.

These and other objects and benefits of the invention will be more clearly understood with reference to the attached drawings and appended claims. This description of the preferred embodiment is not intended to be a limitation on any obvious and expected variations of the above-described invention.

The embodiments of the invention in which an exclusive property or privilege is claimed are defined as follows.

1. A method for constructing a plaza deck/parking structure, comprising:

providing a plurality of panels of foam plastic insulation having an alternatively channeled and ribbed surface structure;

providing a porous fabric layer sufficiently porous to permit the passage of water vapor therethrough but not so porous that wet concrete would significantly penetrate therethrough;

affixing the fabric layer to the top of said ribs on each of said panels;

providing a base deck;

placing a waterproof membrane on top of said base deck;

placing the plurality of panels of foam plastic insulating on top of said waterproof membrane; and pouring wet concrete on top of the moisture permeable fabric layer and allowing the concrete to cure to a solid layer.

2. The method of constructing a plaza deck/parking structure, as described in claim 1, in which the foam plastic insulation panels are made of foam polystryrene.

3. The method of constructing a plaza deck/parking structure, as described in claim 1, in which said alternatively channeled and ribbed surface structure is in a rectangular pattern.

4. The method of constructing a plaza deck/parking structure, as described in claim 1, in which said porous fabric layer is made of non-woven fabric.

5. The method of constructing a plaza deck/parking structure, as described in claim 1, in which said porous fabric layer is made of woven fabric.

6. The method of constructing a plaza deck/parking structure, as described in claim 1, in which said porous fabric layer is made of polypropylene fabric.

7. The method of construction a plaza deck/parking structure, as described in claim 1, in which said porous fabric layer is made of fiberglass fabric.

8. The method of constructing a plaza deck/parking structure, as described in claim 1, in which said panels of foam plastic insulation are between ¼ to 4 feet long and between 4 feet to 20 feet wide.

9. The method of constructing a plaza deck/parking structure, as described in claim 1, in which said panels of foam plastic insulation are 2 feet long and from 4 to 8 feet wide.

10. The method of constructing a plaza deck/parking structure, as described in claim 1, in which said channels in said panels of foam plastic insulation are from 1/16 inch to 1 inch wide and from 1/10 inch to 1 inch deep.

11. The method of constructing a plaza deck/parking structure, as described in claim 1, in which said ribs in said panels of foam plastic insulation are from ⅛ inch to 5 inches wide.

12. The method of constructing a plaza deck/parking structure, as described in claim 1, in which said panels of foam plastic insulation have a compressive strength of from 1,440 pounds per square foot to 28,800 pounds per square foot.

13. The method of claim 1, wherein the porous fabric layer is affixed to the top of said ribs by means of an adhesive.

14. The method for constructing a plaza deck/parking structure of claim 1 in which said panels of foam plastic have a channeled and ribbed surface structure on both their top and bottom surfaces.

15. The method of constructing a plaza deck/parking structure, as described in claim 14, in which the foam plastic insulation panels are made of foam polystyrene.

16. The method of constructing a plaza deck/parking structure, as described in claim 14, in which said alternatively channeled and ribbed surface structures are in matching rectangular patterns.

17. The method of constructing a plaza deck/parking structure as described in claim 14, in which said porous fabric layer is made of non-woven fabric.

18. The method of constructing a plaza deck/parking structure, as described in claim 14, in which said porous fabric layer is made of woven fabric.

19. The method of constructing a plaza deck/parking structure, as described in claim 14, in which said porous fabric layer is made of polypropylene fabric.

20. The method of constructing a plaza deck/parking structure, as described in claim 14, in which said porous fabric layer is made of fiberglass fabric.

21. The method of constructing a plaza deck/parking structure, as described in claim 14, in which said panels of foam plastic insulation are between ¼ to 4 feet long and between 4 feet to 20 feet wide.

22. The method of constructing a plaza deck/parking structure, as described in claim 14, in which said panels of foam plastic insulation are 2 feet long and from 4 to 8 feet wide.

23. The method of constructing a plaza deck/parking structure, as described in claim 14, in which said channels in said panels of foam plastic insulation are from 1/6 wide to 1 inch wide and from 1/10 inch to 1 inch deep.

24. The method of constructing a plaza deck/parking structure, as described in claim 14, in which said ribs in said panels of foam plastic insulation are from ⅛ inch to 5 inches wide.

25. The method of constructing a plaza deck/parking structure, as described in claim 14, in which said panels of foam plastic insulation have a compressive strength of form 1,440 pounds per square foot to 28,000 pounds per square foot.

26. The method of claim 14, wherein the porous fabric layer is affixed to the top of said ribs by means of an adhesive.

* * * * *